US006752606B2

(12) United States Patent
Koo

(10) Patent No.: US 6,752,606 B2
(45) Date of Patent: Jun. 22, 2004

(54) ROTATION PREVENTIVE DEVICE FOR SCROLL COMPRESSOR

(75) Inventor: In Hwe Koo, Seongnam-Si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/043,230

(22) Filed: Jan. 14, 2002

(65) Prior Publication Data

US 2002/0187063 A1 Dec. 12, 2002

(30) Foreign Application Priority Data

May 3, 2001 (KR) ..... 2001-24119

(51) Int. Cl.[7] ..... F04C 18/04
(52) U.S. Cl. ..... 418/55.3; 464/102
(58) Field of Search ..... 418/55.3; 464/102

(56) References Cited

U.S. PATENT DOCUMENTS 4,371,323 A * 2/1983 Fischer et al. ..... 418/55.3
5,899,676 A * 5/1999 Iizuka ..... 418/55.3

FOREIGN PATENT DOCUMENTS

JP 58160578 A * 9/1983 ..... F04C/18/02
JP 60178901 A * 9/1985 ..... F01C/1/02
JP 04036084 A * 2/1992 ..... F04C/18/02
JP 04060189 A * 2/1992 ..... F04C/18/107

* cited by examiner

*Primary Examiner*—Thomas Denion
*Assistant Examiner*—Theresa Trieu
(74) *Attorney, Agent, or Firm*—Birch, Stewart, Kolasch & Birch, LLP

(57) ABSTRACT

In a rotation preventive device for a scroll compressor, by forming a rotation preventive member for preventing a rotation of an orbiting scroll between a frame and an orbiting scroll or a fixed scroll and the orbiting scroll as a rectangular shape performable a sliding motion in a radial direction, it is possible to fabricate the rotation preventive member as small and light weight, accordingly the cost of materials can be reduced. In addition, by reducing abrasion between each key and each key groove, a stability of the orbiting scroll can be maintained, and by preventing a leakage of gas from happening, a reliability and an efficiency of a compressor can be improved and a noise of the compressor can be decreased.

9 Claims, 10 Drawing Sheets

ROTATION PREVENTIVE DEVICE FOR SCROLL COMPRESSOR

BACKGROUND OF THE INVENTION

1. Field of the Invention

The present invention relates to a scroll compressor, and in particular to a rotation preventive device for a scroll compressor which is capable of preventing a rotation of a scroll compressor.

2. Description of the Background Art

Generally, a scroll compressor compresses a fluid such as air or refrigerant gas, etc. by orbiting in a state storing gas between two wraps having an involute shape.

As depicted in FIG. 1, the scroll compressor is constructed with a power generating part generating a driving force and a compressing mechanism part compressing gas by the driving force transmitted from the power generating part.

FIG. 1 is a longitudinal sectional view illustrating a compressing mechanism part of the conventional scroll compressor.

As depicted in FIG. 1, in the compressing mechanism part of the conventional scroll compressor, a fixed scroll 2 having an involute-shaped wrap 2*a* is combined with the upper surface of a frame 1, and an orbiting scroll 3 having an involute-shaped wrap 3*a* engaging with the wrap 2*a* of the fixed scroll 2 is eccentrically combined between the frame 1 and the fixed scroll 2 so as to perform an orbiting motion.

A suction hole 2*b* at which a fluid is sucked is formed at the side of the fixed scroll 2, and a discharge hole 2*c* is formed at the upper central portion of the fixed scroll 2 in order to discharge compressed gas.

A boss portion 3*d* projecting from the bottom surface of the orbiting scroll 3 is combined with an eccentricity portion 4*a* of a rotational shaft 4 rotated by a power generating part (not shown).

Particularly, a rotation preventive member 10 called as an oldham coupling is installed between the frame 1 and the orbiting scroll 3 in order to prevent a rotation of the orbiting scroll 3.

In FIG. 1, unexplained reference numeral P1 and P2 indicate a compressive space formed between the wrap 2*a* of the fixed scroll 2 and the wrap 3*a* of the orbiting scroll 3.

FIG. 2 is a disassembled perspective view illustrating a combination relation of the rotation preventive member in more detail.

In the rotation preventive member 10, a first and a second keys 12*a*, 12*b* projecting from the upper surface of a ring body 11 as a rectangular shape are placed in a straight line, and a third and a fourth keys 12*c*, 12*d* projecting from the bottom surface of the ring body 11 as a rectangular shape are placed in a straight line at right angles to the straight line connecting the first and the second keys 12*a*, 12*b*.

In order to insert the first and the second keys 12*a*, 12*b* and move them in a straight line, key grooves 3*b*, 3*c* are respectively formed at the bottom surface of the orbiting scroll 3 in a straight line.

In order to insert the third and the fourth keys 12*c*, 12*d* and move them in a straight line, key grooves 1*a*, 1*b* are respectively formed at the upper surface of the frame 1 in a straight line.

In addition, as depicted in FIG. 1, a through hole 1*c* at which the rotational shaft 4 penetrates through is formed at the central portion of the frame 1, and a step portion 1*d* forming a thrust bearing face is formed around the through hole 1*c* in order to support rotatively the bottom surface of the orbiting scroll 3.

Accordingly, when the rotation preventive member 10 is placed between the frame 1 and the orbiting scroll 3, the first and the second keys 12*a*, 12*b* are respectively inserted into the key grooves 3*b*, 3*c* of the orbiting scroll 3, and the third and the fourth keys 12*c*, 12*d* are respectively inserted into the key grooves 1*a*, 1*b* of the frame 1.

The operation of the conventional scroll compressor will be described with reference to accompanying FIG. 3.

When power is applied to the power generating part (not shown), a driving force generated by the power generating part is transmitted to the rotational shaft 4, the orbiting scroll 3 orbits by engaging with the fixed scroll 2 by the rotation preventive member 10, in the orbiting process, while the pair of compressing spaces (P1) (P2) are consecutively moved to the discharge hole 2*c*, a body capacity of the pair of compressing spaces (P1) (P2) existed between the wrap 2*a* of the fixed scroll 2 and the wrap 3*a* of the orbiting scroll 3 is gradually decreased, accordingly gas sucked through the suction hole 2*b* is discharged outside through the discharge hole 2*c*.

In more detail, the orbiting scroll 3 tends to rotate eccentrically together with the rotational shaft 4, however because each key 12*a*, 12*b*, 12*c*, 12*d* of the rotation preventive member 10 is inserted into each key groove 3*b*, 3*c* of the orbiting scroll 3 and 1*a*, 1*b* of the frame 1 slidable only in a radial direction, the side of each key 12*a*, 12*b*, 12*c*, 12*d* contacts to the correspondence face of each key groove 3*b*, 3*c*, 1*a*, 1*b*, accordingly it is possible to prevent the orbiting scroll 3 from rotating.

Accordingly, under the condition restricted to perform the rotating motion by the rotation preventive member 10, the orbiting scroll 3 can compress a fluid while performing the orbiting motion in a specific orbit around the upper surface of the frame 1.

However, in the conventional scroll compressor, because the rotation preventive member 10 has a ring shape, as depicted in FIG. 4, when the orbiting scroll 3 orbits, a bending stress occurs on the ring body 11 by a reaction force $F_0$, $F_f$ acting on each contacting face ($\mathbf{0}_{01}$) ($\mathbf{0}_{02}$) ($\mathbf{0}_{f1}$) ($\mathbf{0}_{f2}$) of each key (12*a*, 12*b*), (12*c*, 12*d*).

Because the bending stress occurred at the ring body 11 is relatively larger than a general tension stress or a compressive stress, the rotation preventive member 10 may be deformed. Accordingly, in order to prevent the deformation of the rotation preventive member 10, the rotation preventive member 10 has to be designed in large, accordingly the cost of materials has to be increased.

In addition, when the rotation preventive member 10 is designed in large, a weight of the rotation preventive member 10 is increased, a reaction force variation range of each key 12*a*, 12*b*, 12*c*, 12*d* greatly influenced by an inertia is increased, accordingly a maximum reaction force acting on each key 12*a*, 12*b*, 12*c*, 12*d* of the rotation preventive member 10 is increased.

In more detail, FIG. 5 is a graph illustrating a reaction force value occurred at each contacting face ($\mathbf{0}_{01}$) ($\mathbf{0}_{02}$) ($\mathbf{0}_{f1}$) ($\mathbf{0}_{f2}$) of the rotation preventive member 10 according to an orbit angle when a mass of the rotation preventive member 10 is one third of a mass of the orbiting scroll 3. FIG. 6 is a graph illustrating a reaction force value occurred at each contacting face ($\mathbf{0}_{01}$) ($\mathbf{0}_{02}$) ($\mathbf{0}_{f1}$) ($\mathbf{0}_{f2}$) of the rotation preventive member 10 according to an orbit angle when a mass of the rotation preventive member 10 is 0. With reference to FIGS. 5 and 6, a reaction force between the contacting faces ($\mathbf{0}_{01}$) ($\mathbf{0}_{02}$) of the rotation preventive member 10 contacting to the orbiting scroll 3 is increased as a mass of the rotation preventive member 10 is increased.

Accordingly, abrasion of each key 12*a*, 12*b*, 12*c*, 12*d* is increased in accordance with an increase of a mass of the rotation preventive member 10, according to it a leakage of compressing gas may be occurred and a noise due to collision between each key 12*a*, 12*b*, 12*c*, 12*d* with each key groove 3*b*, 3*c*, 1*a*, 1*b* may be increased.

SUMMARY OF THE INVENTION

Accordingly, in order to solve above-mentioned problems, it is an object of the present invention to provide a rotation preventive device for a scroll compressor which is capable of retrenching a production cost by reducing a size of a rotation preventive member so as to act a tension stress and a compressive stress on the rotation preventive member besides a bending stress.

It is another object of the present invention to provide a rotation preventive device for a scroll compressor which is capable of minimizing an abrasion occurrence and improving a reliability of a compressor by reducing a reaction force between each key and each key groove by materializing a lightweight rotation preventive member.

In order to achieve the above-mentioned objects, a rotation preventive device for a scroll compressor in accordance with the present invention includes a ring body formed as a ring shape and placed between an orbiting scroll and a frame, a plurality of keys respectively projecting from the ring body and inserted into each key groove of the orbiting scroll and the frame, wherein the ring body is formed so as to have a body capacity linearly connected with the keys abutting each other.

Each key has a contacting face contacted to each key groove, and the ring body is formed so as to have a body capacity linearly connected with the contacting faces abutting each other.

The ring body is formed so as to have a body capacity linearly connected with the centers of the contacting faces abutting each other.

The ring body is formed by linearly connecting the both ends of the contacting face with the both ends of the other contacting face.

The ring body is formed as a rectangular shape in accordance with an embodiment of the present invention.

The ring body is formed as an expanded shape by increasing a sectional area of at least one of a medial surface or a lateral outer surface in accordance with another embodiment of the present invention.

Herein, the medial surface of the ring body connects each key straightly, and the lateral surface of the ring body connects each key circularly.

The lateral surface of the ring body connects each key straightly, and the medial surface of the ring body connects each key circularly.

Two of the plurality of keys are respectively formed at the upper surface and the bottom surface of the ring body at regular intervals.

In a rotation preventive device for a scroll compressor in accordance with the present invention, by forming a rotation preventive member so as to act a tension stress and a compressive stress besides a bending stress, it is possible to fabricate the rotation preventive member as small and light weight, accordingly the cost of materials can be reduced. In addition, by reducing abrasion between each key and each key groove, a stability of the orbiting scroll can be maintained, and by preventing a leakage of gas from happening, a reliability and an efficiency of a compressor can be improved.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Hereinafter, embodiments of a rotation preventive member for a scroll compressor in accordance with the present invention will be described in detail with reference to accompanying drawings.

Figure 7:
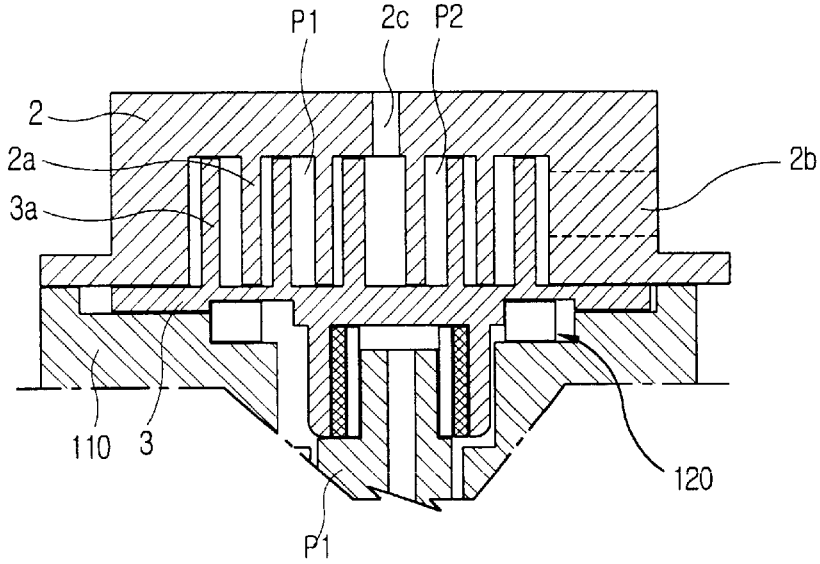
FIG. 7 is a longitudinal sectional view illustrating a compressing mechanism part of a scroll compressor in accordance with a first embodiment of the present invention.
Figure 8:
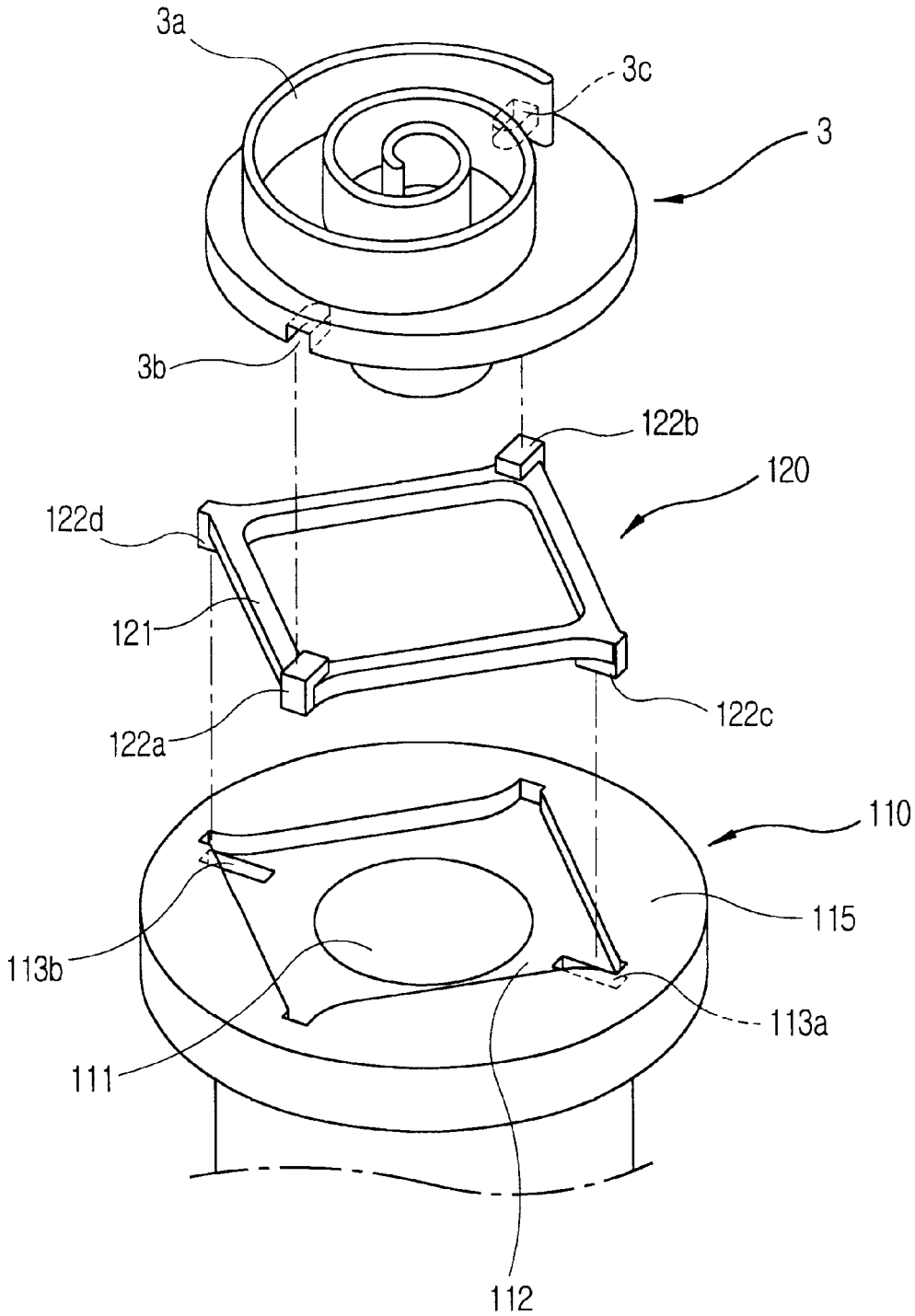
FIG. 8 is a disassembled perspective view illustrating the compressing mechanism part of the scroll compressor in accordance with the first embodiment of the present invention.
Figure 9:
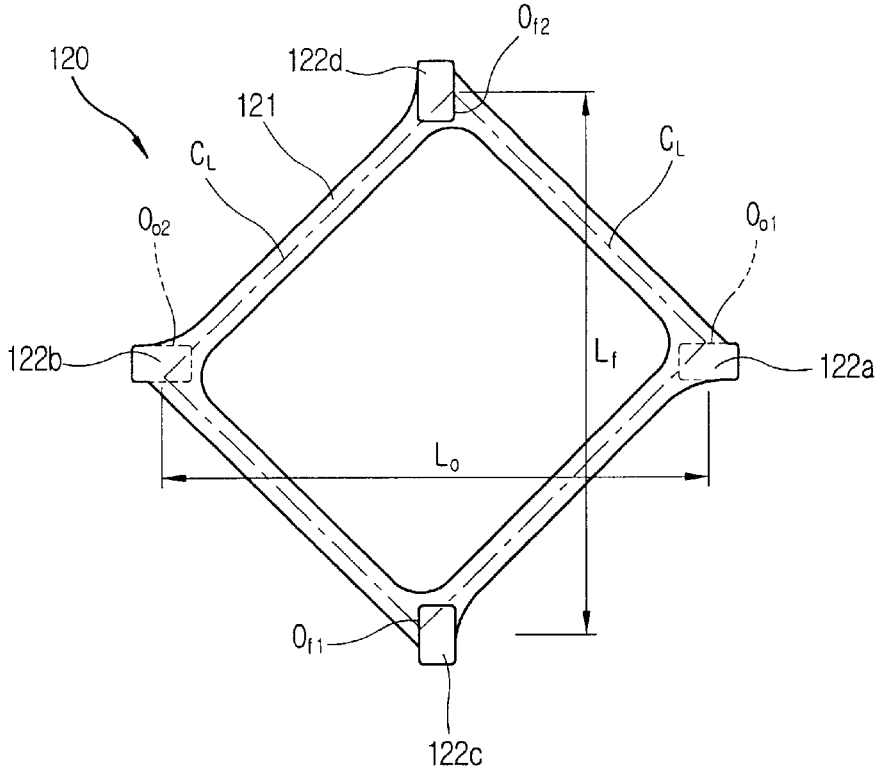
FIG. 9 is a plan view illustrating a rotation preventive member in accordance with the first embodiment of the present invention.
Figure 10:
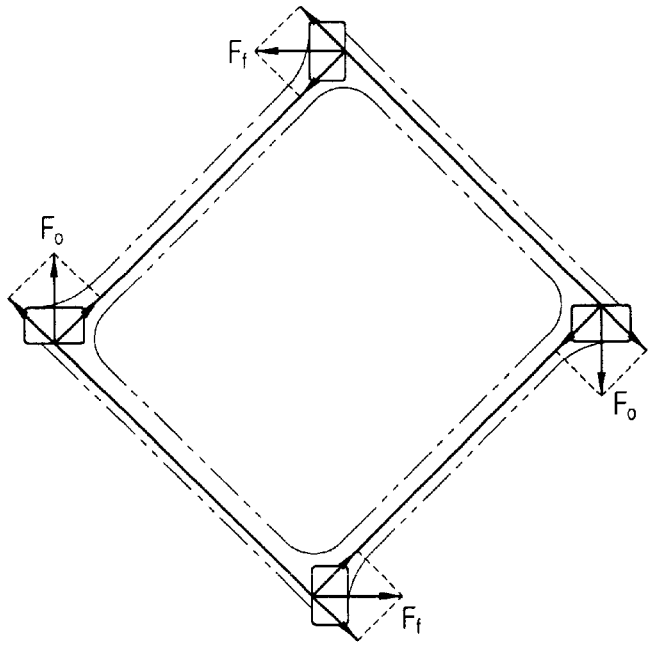
FIG. 10 is a perspective view illustrating a state of a reaction force acting on the rotation preventive member in accordance with the first embodiment of the present invention.

FIGS. 7~9 illustrate a rotation preventive member for a scroll compressor in accordance with a first embodiment of the present invention, herein FIG. 7 is a longitudinal sectional view illustrating a compressing mechanism part of a scroll compressor in accordance with a first embodiment of the present invention, FIG. 8 is a disassembled perspective view illustrating the compressing mechanism part of the scroll compressor in accordance with the first embodiment of the present invention, and FIG. 9 is a plan view illustrating a rotation preventive member in accordance with the first embodiment of the present invention. In FIGS. 7~9, the same reference numerals will be given to the same parts as the conventional art.

A scroll compressor having a rotation preventive device in accordance with a first embodiment of the present invention includes a frame 110 fixed inside of a closed container (not shown), a fixed scroll 2 fixed to the upper portion of the frame 110, an orbiting scroll 3 having a wrap 3*a* engaging with a wrap 2*a* of the fixed scroll 2 and eccentrically combined with a rotational shaft 4 combined with a power generating part (not shown), and a rotation preventive member 120 placed between the frame 100 and the orbiting scroll 3 so as to be slidable in the radial direction in order to prevent a rotation of the orbiting scroll 3.

A through hole 111 is formed at the central portion of the frame 110 so as to be penetrated by the rotational shaft 4 combined with a rotor (not shown) of the power generating part and form a radial bearing face about the rotational shaft 4, and a seating portion 112 having a groove shape is formed around the through hole 111 in order to mount the rotation preventive member 120 and make the rotation preventive member 120 move in a certain orbit.

A third key groove 113*a* and a fourth key groove 113*b* at which a third key 122*c* and a fourth key 122*d* are inserted into are formed at the seating portion 112 in a straight line.

In addition, a thrust bearing face 115 precisely processed as a flat face so as to be face-contacted with the orbiting scroll 3 is formed at the upper surface of the frame 110 as the edge of the seating portion 112.

Unlike a structure placing a thrust bearing face inside a rotation preventive member, by placing the thrust bearing face 115 at the edge of a portion at which the rotation preventive member 120 is placed, it is possible to provide a more stable contact supporting structure for the orbiting scroll 3.

The wrap 3*a* forming a pair of compressing spaces P1, P2 by engaging with the wrap 2*a* of the fixed scroll 2 is formed at the orbiting scroll 3, and a first key groove 3*b* and a second key groove 3*c* at which a first key 122*a* and a second key 122*b* of a rotation preventive member 120 are slidably inserted into are formed at the bottom both sides of the orbiting scroll 3 in the same straight line.

The rotation preventive member 120 is constructed with a rectangular-shaped ring body housed in the seating portion 112 of the frame 110, a first key 122*a* and a second key 122*b* projecting from the upper surface of the ring body 121 as a rectangular shape and slidably inserted into each key groove 3*b*, 3*c* of the orbiting scroll3, and a third key 122*c* and a fourth key 122*d* projecting from the bottom surface of the ring body 121 and slidably inserted into each key groove 113*a*, 113*b* of the frame 110.

Herein, as depicted in FIG. 9, the ring body 121 has a rectangular shape constructed with a straight medial and lateral surfaces, and keys 122*a*, 122*b*, 122*c*, 122*d* are respectively formed at vertex portions at which the straight portions of the ring body 121 meet each other.

Particularly, a body capacity of the straight portions is formed so as to not to go wide of the centrical line ($C_L$) connecting the center of the contacting faces ($\mathbf{0}_{f1}$) ($\mathbf{0}_{f2}$) of the keys 122*c*, 122*d* contacted to the frame 110 to the center of the contacting faces ($\mathbf{0}_{01}$) ($\mathbf{0}_{02}$) of the keys 122*a*, 122*b* contacted to the orbiting scroll 3.

In FIG. 9, the part or the entire straight portions of the ring body 121 overlap with the body capacity range connecting the both sides of the contacting faces ($\mathbf{0}_{01}$) ($\mathbf{0}_{02}$) with the both sides of the contacting faces ($\mathbf{0}_{f1}$) ($\mathbf{0}_{f2}$) without going wide of the central line ($C_L$).

In the meantime, in each key 122*a*, 122*b*, 122*c*, 122*d*, it is preferable to set a length ($L_0$) connecting diagonally the center of the contacting face of the key 122*a* to the center of the contacting face of the other key 122*b* so as to be same with a length ($L_f$) connecting diagonally the center of the contacting face of the key 122*c* to the center of the contacting face of the other key 122*d*, herein the lengths ($L_0$) ($L_f$) can be differently set in accordance with design conditions of a compressor.

In FIG. 7, unexplained reference numeral 2*b* is a suction hole, and unexplained reference numeral 2*c* is a discharge hole.

The operation and effects of the rotation preventive device for the scroll compressor in accordance with the present invention will be described in detail.

When power is applied to the power generating part, the rotational shaft 4 is rotated, the orbiting scroll 3 eccentrically combined with the rotational shaft 4 consecutively sucks the refrigerant gas into the compressing space formed between the orbiting scroll 3 and the fixed scroll 2, compresses and discharges it while orbiting about the upper surface of the frame 110.

Herein, the rotation preventive member 120 is combined between the frame 110 and the orbiting scroll 3 in order to prevent the rotation of the orbiting scroll 3, accordingly when each key 122*a*, 122*b*, 122*c*, 122*d* of the rotation preventive member 120 contacts to each key groove 3*b*, 3*c*, 113*a*, 13*b* of the orbiting scroll 3 or the frame 110, the reaction force acts on each key 122*a*, 122*b*, 122*c*, 122*d* can be reduced.

As described above, when the reaction force acts on each key 122*a*, 122*b*, 122*c*, 122*d*, because the rotation preventive member 120 is formed as a rectangular shape, mainly the compressive stress or the tension stress acts on the straight portions of the ring body 121.

Herein, the compressive stress or the tension stress has a sharply lower value than a bending stress occurred in the conventional circular-shaped rotation preventive member, accordingly a maximum value of the reaction force on each key 122*a*, 122*b*, 122*c*, 122*d* can be decreased.

The operation of the rotation preventive member in accordance with the present invention will be described in more detail.

Generally, the reaction force on each key 122*a*, 122*b*, 122*c*, 122*d* of the rotation preventive member 120 can be largely divided into a reaction force by a torque acting in order to prevent the rotation of the orbiting scroll 3 and an inertia force of the rotation preventive member 120 acting on the contacting faces ($\mathbf{0}_{01}$) ($\mathbf{0}_{02}$) contacting to the orbiting scroll 3.

When a capacity of the compressor is set, the reaction force by the torque can be adjusted according to a distance between keys, in addition, when a distance between keys is regular, a rotation moment of the orbiting scroll 3 and a torque preventing the rotation are determined, however the inertia force of the rotation preventive member 120 can be increased or decreased according to a structure of the rotation preventive member 120.

Figure 1:
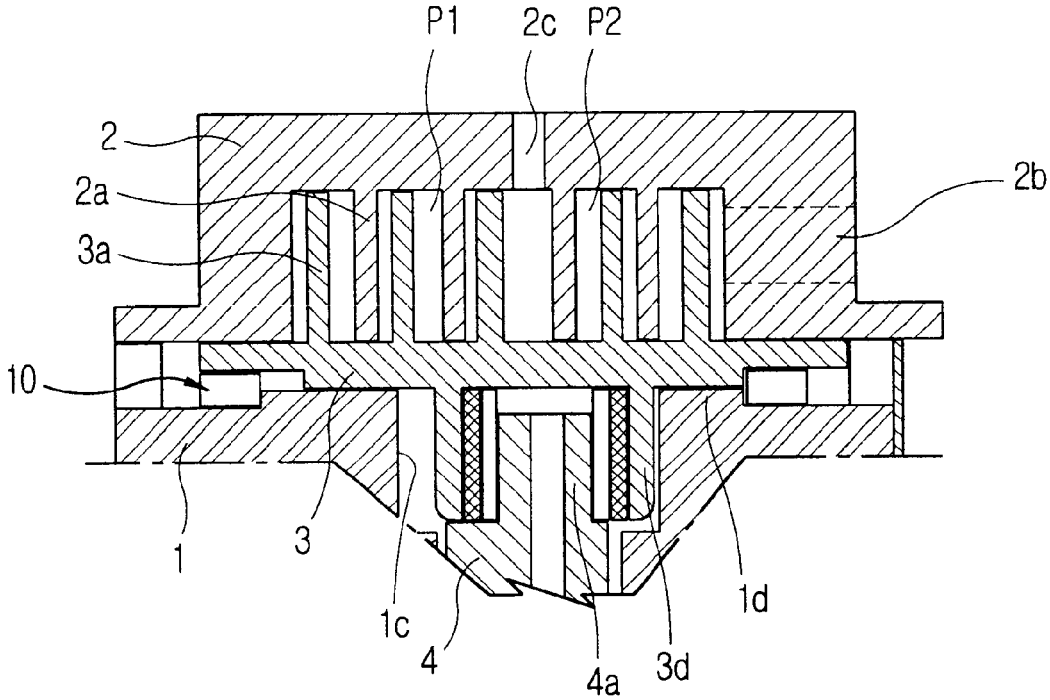
FIG. 1 CONVENTIONAL ART
FIG. 1 is a longitudinal sectional view illustrating a compressing mechanism part of the conventional scroll compressor.
Figure 2:
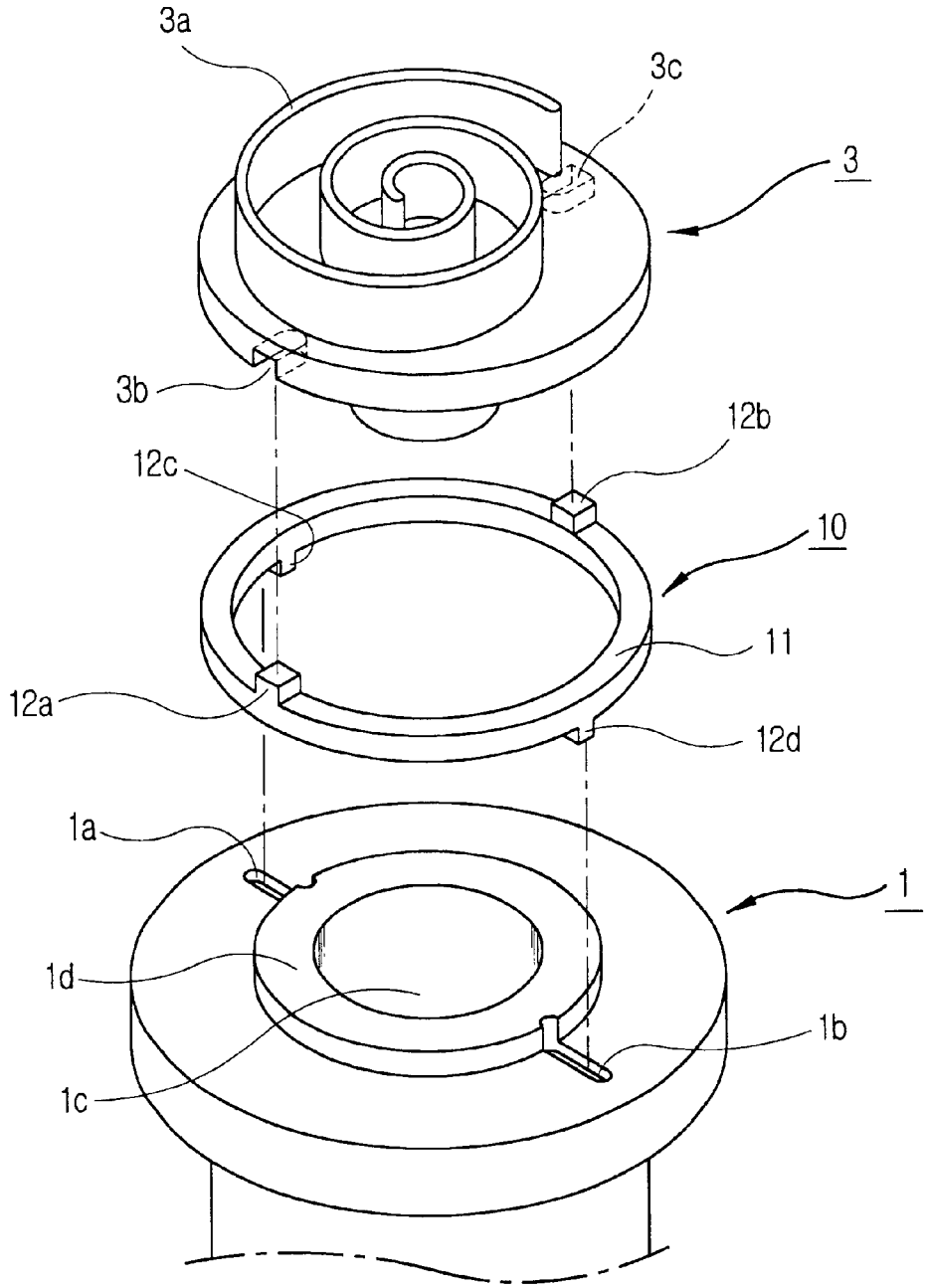
FIG. 2 CONVENTIONAL ART
FIG. 2 is a disassembled perspective view illustrating a combination relation of the rotation preventive member.
Figure 3:
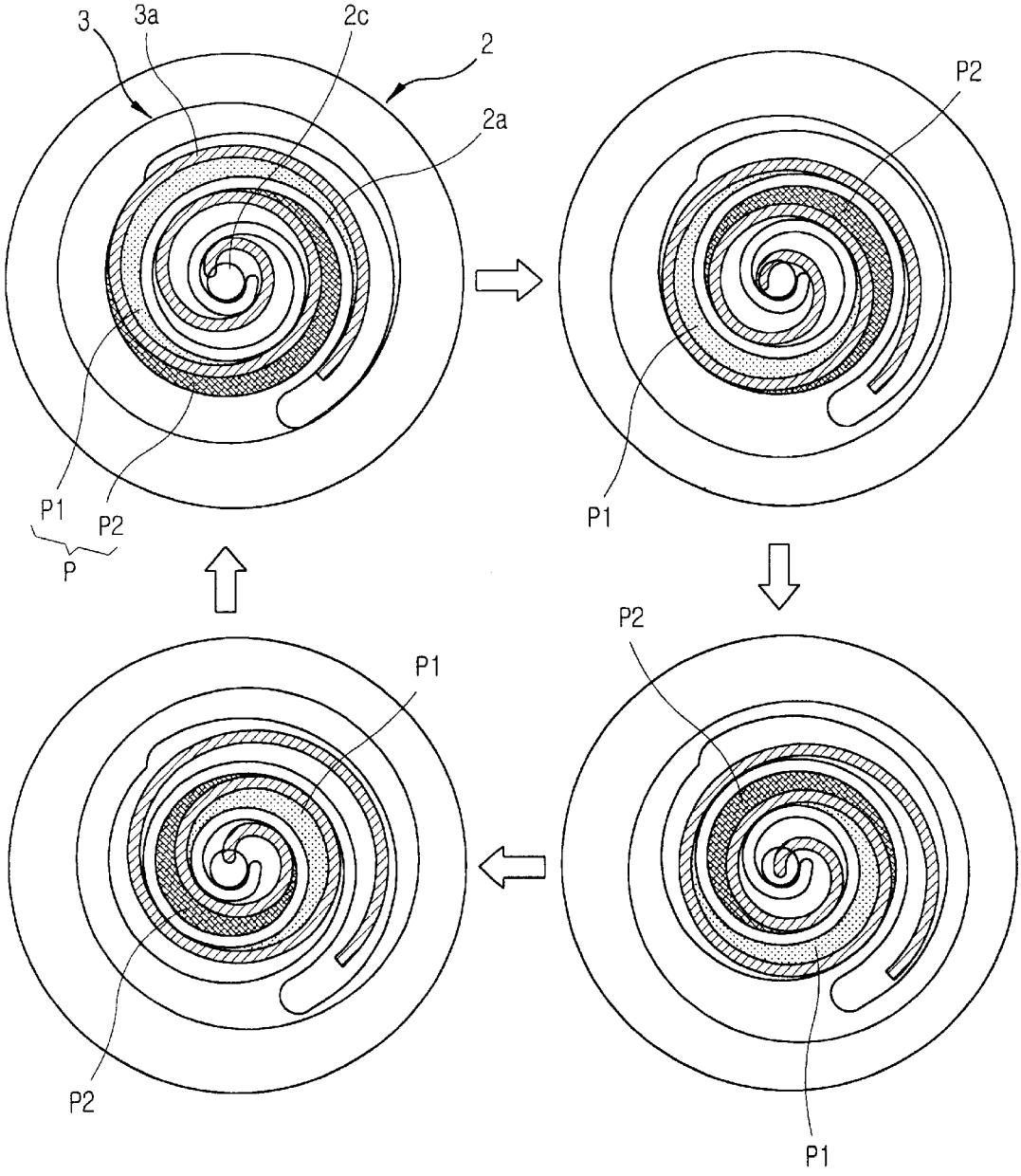
FIG. 3 CONVENTIONAL ART
FIG. 3 is an operation flow chart illustrating a compressing principle of the conventional scroll compressor.
Figure 4:
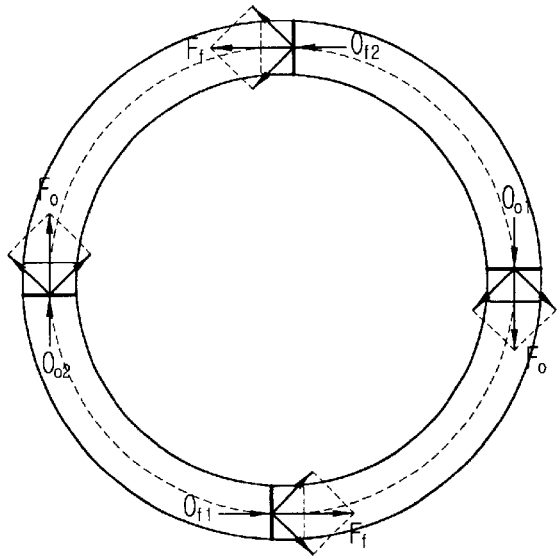
FIG. 4 CONVENTIONAL ART
FIG. 4 is a perspective view illustrating a state of a reaction force acting on the rotation preventive member of the conventional scroll compressor.

In more detail, as depicted in FIG. 8, when a moment vertically acts on the contacting faces of each key 122*a*,

122*b*, 122*c*, 122*d*, mainly the compressive force or the tension force acts on the straight portions of the ring body 121, in the comparison with the conventional circular-shaped ring body mainly having the bending stress with reference to accompanying FIG. 4, a size of the stress value is sharply decreased.

Figure 11A:
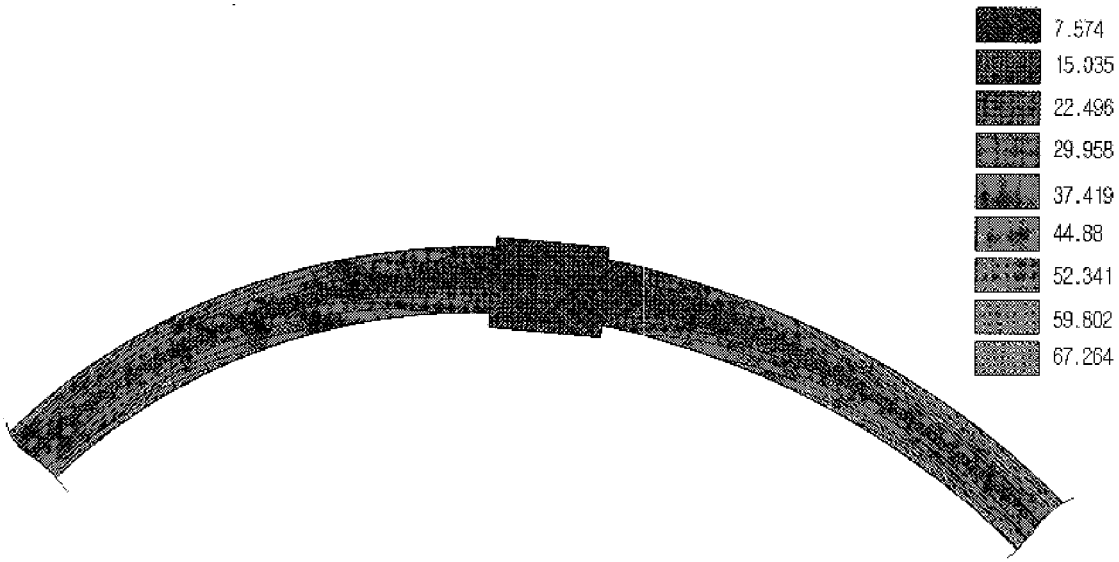
FIGS. 11A and 11B illustrate a distribution of a stress on a ring-shaped rotation preventive member and a rectangular-shaped rotation preventive member.
Figure 11B:
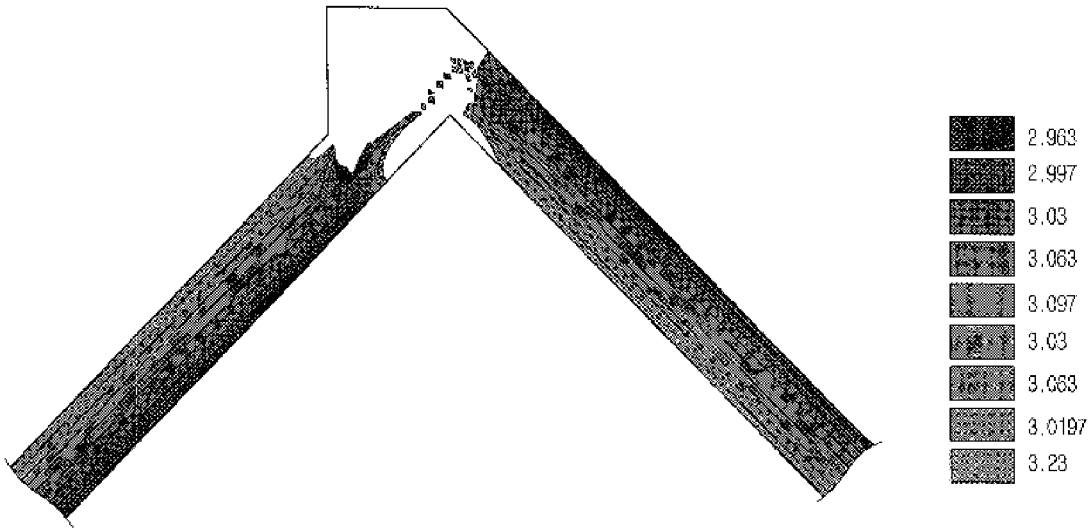

A stress distribution in the conventional circular-shaped ring body and a stress distribution in the rectangular-shaped ring body in accordance with the present invention can be compared with reference to accompanying FIGS. 11A and 11B.

In addition, below table respectively illustrates a maximum stress value in the conventional circular-shaped ring body and a maximum stress value in the rectangular-shaped ring body in accordance with the present invention.

| Type | Area | Maximum Stress |
|---|---|---|
| Circular Ring Body | 1612.8 $mm^2$ | 67.264 MPa |
| Rectangular Ring Body | 1569.0 $mm^2$ | 3.917 MPa |

Accordingly, it is assumed that a sectional area of each ring body is the same, a strength of the rotation preventive member 120 in accordance with the present invention is increased, accordingly the operation of the orbiting scroll 3 can be stably maintained. And, in the aspect of the same strength of the rotation preventive member, by forming the ring body 121 as a straight portions, the sectional area of the ring body 121 can be decreased, accordingly a production cost can be lowered by reducing a quantity of aluminum as a material of the ring body 121.

Figure 5:
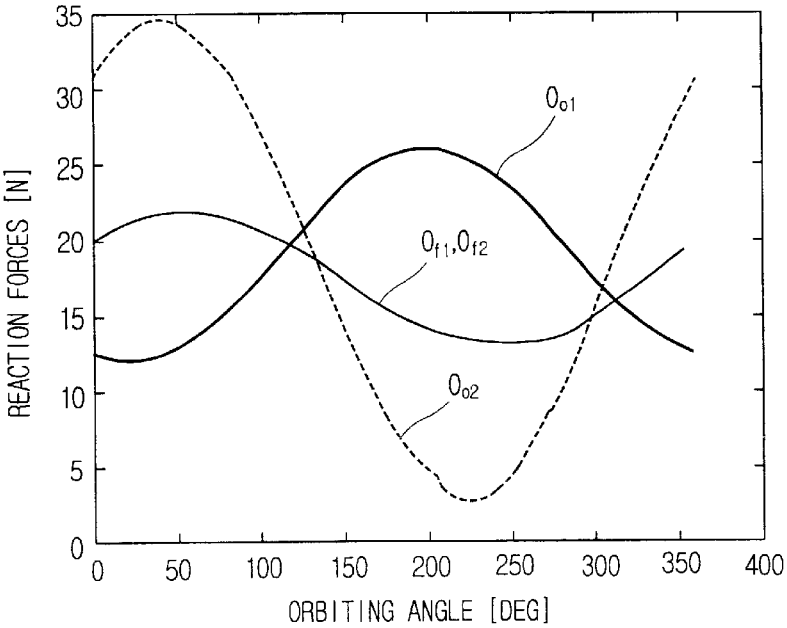
FIG. 5 is a graph illustrating variation of a reaction force occurred at each contacting face of the rotation preventive member when a mass of the rotation preventive member is one third of a mass of an orbiting scroll.
Figure 6:
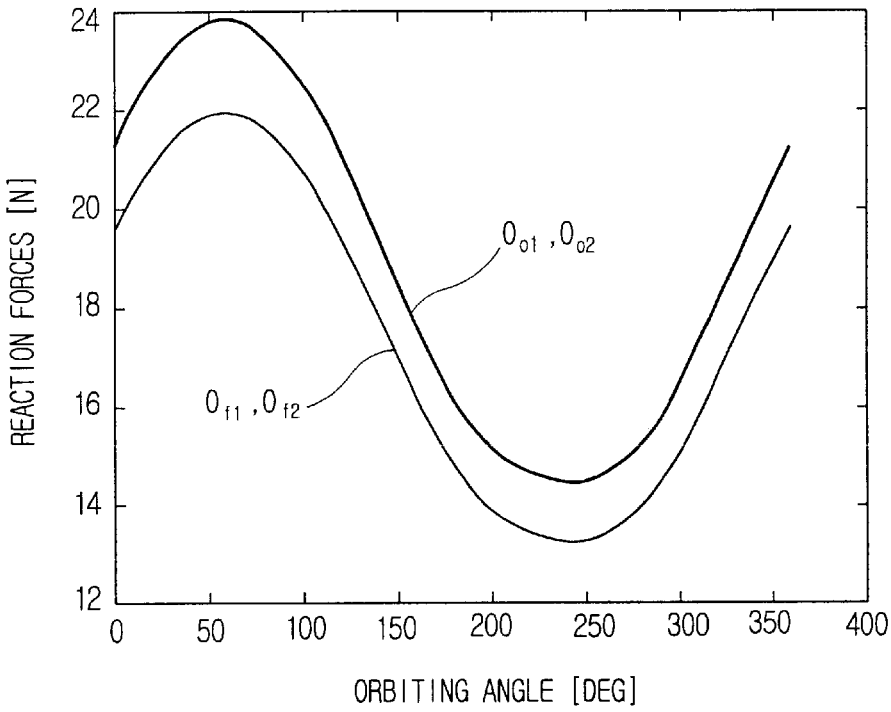
FIG. 6 is a graph illustrating variation of a reaction force occurred at each contacting face of the rotation preventive member when a mass of the rotation preventive member is 0.

In addition, as depicted in FIGS. 5 and 6, by reducing a mass of the rotation preventive member 120, because the variation range of the reaction force between the rotation preventive member 120 and the orbiting scroll 3 and a maximum reaction force acting on the keys 122*a*, 122*b*, 122*c*, 122*d* of the rotation preventive member 120 can be decreased, it is possible to prevent abrasion of the keys 122*a*, 122*b*, 122*c*, 122*d* or the key grooves 3*b*, 3*c*, 113*a*, 113*b*, accordingly a reliability and an efficiency of the compressor can be improved and a noise can be lowered.

In the meantime, as depicted in FIG. 8, by installing the rotation preventive member 120 in the seating portion 112 placed at the inner portion of the frame 110 and forming the thrust bearing face 115 of the frame 110 and the orbiting scroll 3 at the outer portion of the rotation preventive member 120, a length of a moment arm based on the rotational center of the orbiting scroll 3 is lengthened, a restoring moment against the slant tendency of the orbiting scroll 3 is increased, accordingly an operational stability of the orbiting scroll 3 can be improved.

Figure 12:
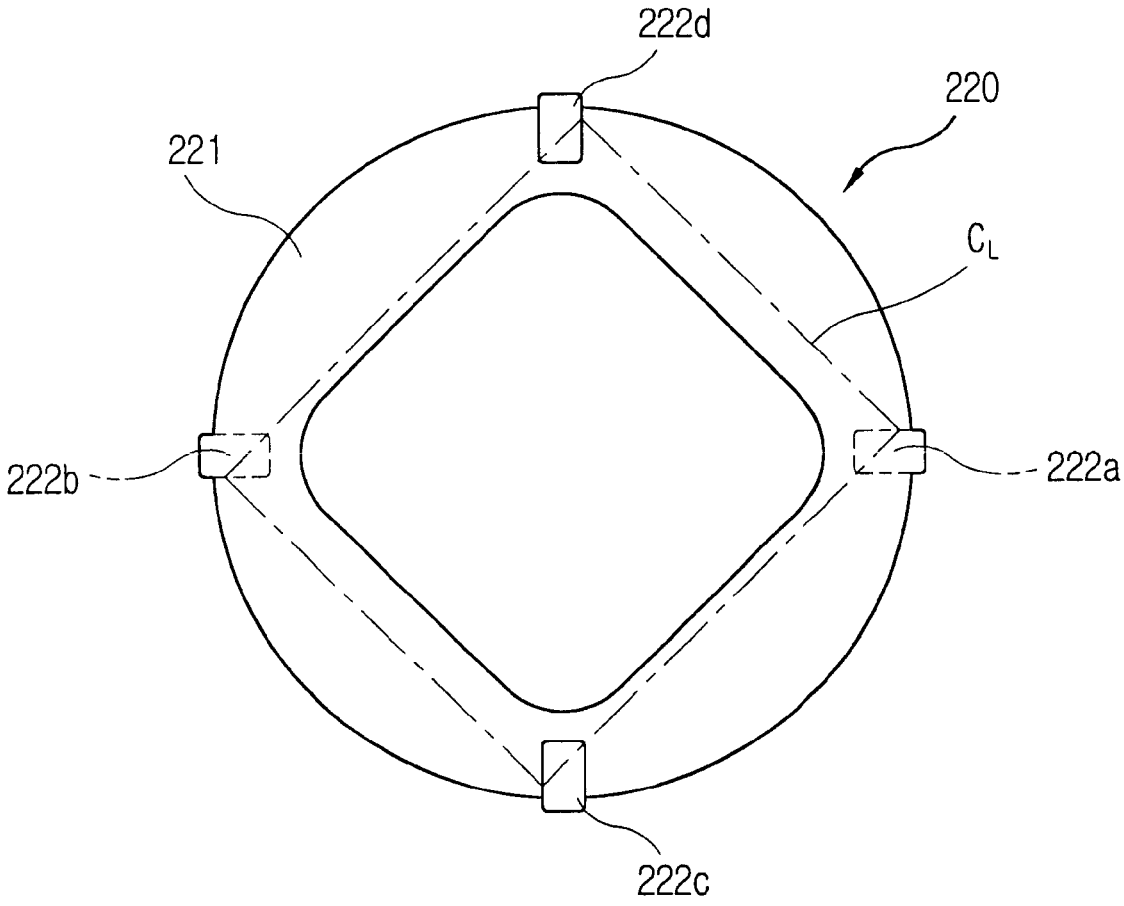
FIG. 12 is a plan view illustrating a rotation preventive member in accordance with a second embodiment of the present invention.

FIG. 12 is a plan view illustrating a rotation preventive member in accordance with a second embodiment of the present invention.

In the first embodiment of the present invention, the ring body 121 is shaped as straight portions and has a rectangular-shaped rotation preventive member 120.

However, as depicted in FIG. 12, in the second embodiment of the rotation preventive member 220 of the present invention, the medial surface of a ring body 221 is formed straightly, but the lateral surface of the ring body 221 is formed circularly, accordingly the sectional area of the ring body 221 is increased due to an increase of a thrust face or additional reasons.

In addition, on the contrary, in the variation of the present invention, the medial surface of a ring body can be formed circularly, and the lateral surface of the ring body can be formed straightly.

In FIG. 12, unexplained reference numerals 222*a*, 222*b*, 222*c*, 222*d* are keys, $C_L$ is a central line connecting the center of the contacting face of the keys 222*a*, 222*b* with the center of the contacting face of the other keys 222*c*, 229*d*.

In the meantime, in the above-described embodiment, the rotation preventive member is installed between the frame and the orbiting scroll, in case of needs, the rotation preventive member can be installed between the fixed scroll and the orbiting scroll. In that case, the rotation preventive member can be formed as a polygonal shape, the operation effect is the same.

In a rotation preventive device for a scroll compressor in accordance with the present invention, by forming a rotation preventive member for preventing a rotation of an orbiting scroll between a frame and an orbiting scroll or a fixed scroll and the orbiting scroll as a rectangular shape performable a sliding motion in a radial direction, it is possible to fabricate the rotation preventive member as small and light weight, accordingly the cost of materials can be reduced. In addition, by reducing abrasion between each key and each key groove, a stability of the orbiting scroll can be maintained, and by preventing a leakage of gas from happening, a reliability and an efficiency of a compressor can be improved and a noise of the compressor can be decreased.

What is claimed is:

1. A rotation preventive device for a scroll compressor, comprising:

a ring body formed as a ring shape and placed between an orbiting scroll and a frame;

a pair of first keys projecting from the ring body and being inserted into each key groove formed in the orbiting scroll; and a pair of second keys projecting from the ring body and being inserted into each key groove formed in the frame, wherein lines connecting respective first surfaces of the first keys, where each first surface contacts the orbiting scroll, with respective second surfaces of the second keys, where each second surface contacts the frame, are projected on a sectional surface of the ring body in a direction perpendicular to the rotational axis of the orbiting scroll, said lines connecting respective centers of the first surfaces with respective centers of the second surfaces.

2. A rotation preventive device for a scroll compressor, comprising:

a ring body formed as a ring shape and placed between an orbiting scroll and a frame;

a pair of first keys projecting from the ring body and being inserted into each key groove formed in the orbiting scroll; and a pair of second keys projecting from the ring body and being inserted into each key groove formed in the frame, wherein lines connecting respective first surfaces of the first keys, where each first surface contacts the orbiting scroll, with respective second surfaces of the second keys, where each second surface contacts the frame, are projected on a sectional surface of the ring body in a direction perpendicular to the rotational axis of the orbiting scroll, the ring body being formed by linearly connecting each first surface with each second surface.

3. A scroll compressor comprising:

a rotation preventive member having a ring body formed so as to have a ring shape and a body capacity linearly connected with a plurality of keys abutting each other and the plurality of keys respectively projecting from the ring body;

a frame having a seating portion having a rectangular groove shape at the upper surface in order to house the rotation preventive member and a plurality of key grooves at the seating portion at which the plurality of keys are inserted including two key grooves formed at diagonal two portions; and an orbiting scroll placed at the upper portion of the frame so as to have the rotation preventive member between them, having a wrap at the upper surface so as to engage with a wrap of a fixed scroll and a plurality of key grooves at the bottom surface at which the plurality of keys are inserted.

4. A rotation preventive device for a scroll compressor, comprising:

a ring body formed as a ring shape and placed between an orbiting scroll and a frame;

a pair of first keys projecting from the ring body and being inserted into each key groove formed in the orbiting scroll; and a pair of second keys projecting from the ring body and being inserted into each key groove formed in the frame, wherein lines connecting respective first surfaces of the first keys, where each first surface contacts the orbiting scroll, with respective second surfaces of the second keys, where each second surface contacts the frame, are projected on a sectional surface of the ring body in a direction perpendicular to the rotational axis of the orbiting scroll, and wherein said keys have axes arranged at a non-perpendicular angle to sides of said ring body.

5. The device of claim 4, wherein said axes are aligned with diagonals of said ring body.

6. In a scroll compressor comprising a frame, a fixed scroll fixed to the frame, an orbiting scroll placed between the frame and the fixed scroll so as to engage with the fixed scroll and compressing a fluid, and a rotation preventive member installed between the orbiting scroll and the frame or the orbiting scroll and the fixed scroll so as to perform a sliding motion in a radial direction and prevent a rotation of the orbiting scroll, the rotation preventive member, comprising:

a ring body formed as a ring shape; and a pair of first keys and a pair of second keys respectively projecting from the upper portion and the lower portion of the ring body and being inserted into each key groove between the frame and the orbiting scroll or the fixed scroll and the orbiting scroll so as to perform a sliding motion, wherein lines connecting respective first surfaces of the first keys, where each first surface contacts the orbiting scroll, with respective second surfaces of the second keys, where each second surface contacts the frame, are projected on a sectional surface of the ring body in a direction perpendicular to a rotational axis of the orbiting scroll, and wherein said keys have axes arranged at a non-perpendicular angle to sides of said ring body.

7. The device of claim 6, wherein said axes are aligned with diagonals of said ring body.

8. A scroll compressor comprising:

a rotation preventive member having a ring body formed so as to have a ring shape and a pair of first keys and a pair of second keys, respectively projecting from an upper portion and a lower portion of the ring body, wherein lines connecting respective first surfaces of the first keys, where each first surface contacts the orbiting scroll, with respective second surfaces of the second keys, where each second surface contacts the frame, are projected on a sectional surface of a ring body in a direction perpendicular to a rotational axis of the orbiting scroll;

a frame having a seating portion having a groove shape at the upper surface in order to receive the rotation preventive member and a pair of second key grooves at the seating portion which the second keys are inserted into; and an orbiting scroll placed at the upper portion of the frame so as to have the rotation preventive member between them, having a wrap at the upper surface so as to engage with a wrap of a fixed scroll and a pair of first key grooves at the bottom surface at which the first keys are inserted, wherein said keys have axes arranged at a non-perpendicular angle to sides of said ring body.

9. The scroll compressor of claim 8, wherein said axes are aligned with diagonals of said ring body.

* * * * *